US007225716B1

(12) United States Patent
Miller et al.

(10) Patent No.: US 7,225,716 B1
(45) Date of Patent: Jun. 5, 2007

(54) PROCESS FOR REMOVING THE FUZE FROM EXPLOSIVE PROJECTILES USING FLUID JET TECHNOLOGY

(75) Inventors: Paul Miller, Harvest, AL (US); Duane A. Goetsch, Andover, MN (US); John A. Bayer, Minneapolis, MN (US); Steve J. Schmit, Plymouth, MN (US)

(73) Assignee: Gradient Technology, Elk River, MN (US)

( * ) Notice: Subject to any disclaimer, the term of this patent is extended or adjusted under 35 U.S.C. 154(b) by 0 days.

(21) Appl. No.: 09/569,860

(22) Filed: May 12, 2000

(51) Int. Cl.
*F42B 33/06* (2006.01)

(52) U.S. Cl. ..... 86/50

(58) Field of Classification Search ..... 86/50
See application file for complete search history.

(56) References Cited

U.S. PATENT DOCUMENTS 4,376,666 A * 3/1983 Williams, Jr. ..... 149/109.6
5,363,603 A * 11/1994 Miller et al. ..... 451/40
5,524,545 A * 6/1996 Miller et al. ..... 102/293
5,737,709 A * 4/1998 Getty et al. ..... 134/22.12
5,810,995 A * 9/1998 Soilleux et al. ..... 205/688
5,998,676 A 12/1999 Arcuri et al. ..... 568/710
6,011,193 A * 1/2000 Myler et al. ..... 588/318
6,080,907 A * 6/2000 Miller ..... 588/319

FOREIGN PATENT DOCUMENTS

DE 3913479 C1 * 8/1990
EP 622605 A1 * 11/1994

OTHER PUBLICATIONS

Considerations in the Design of a Waterjet Device for Reclamation of Missile Casings, D.A. Summers, L. J. Tyler, J. Blaine, R. D. Fossey, Aug. 1997.*

* cited by examiner

*Primary Examiner*—Troy Chambers
(74) *Attorney, Agent, or Firm*—Henry E. Naylor; Kean, Miller, Hawthorne, D'Armond, McCowan & Jerman, LLP

(57) ABSTRACT

A process for defuzing explosive projectiles using fluid jet technology. It is preferred that two or more projectiles be defuzed simultaneously in the same defuzing apparatus. The explosive material can also be removed from the casing by fluid jet technology, after the projectile has been defuzed.

10 Claims, 1 Drawing Sheet

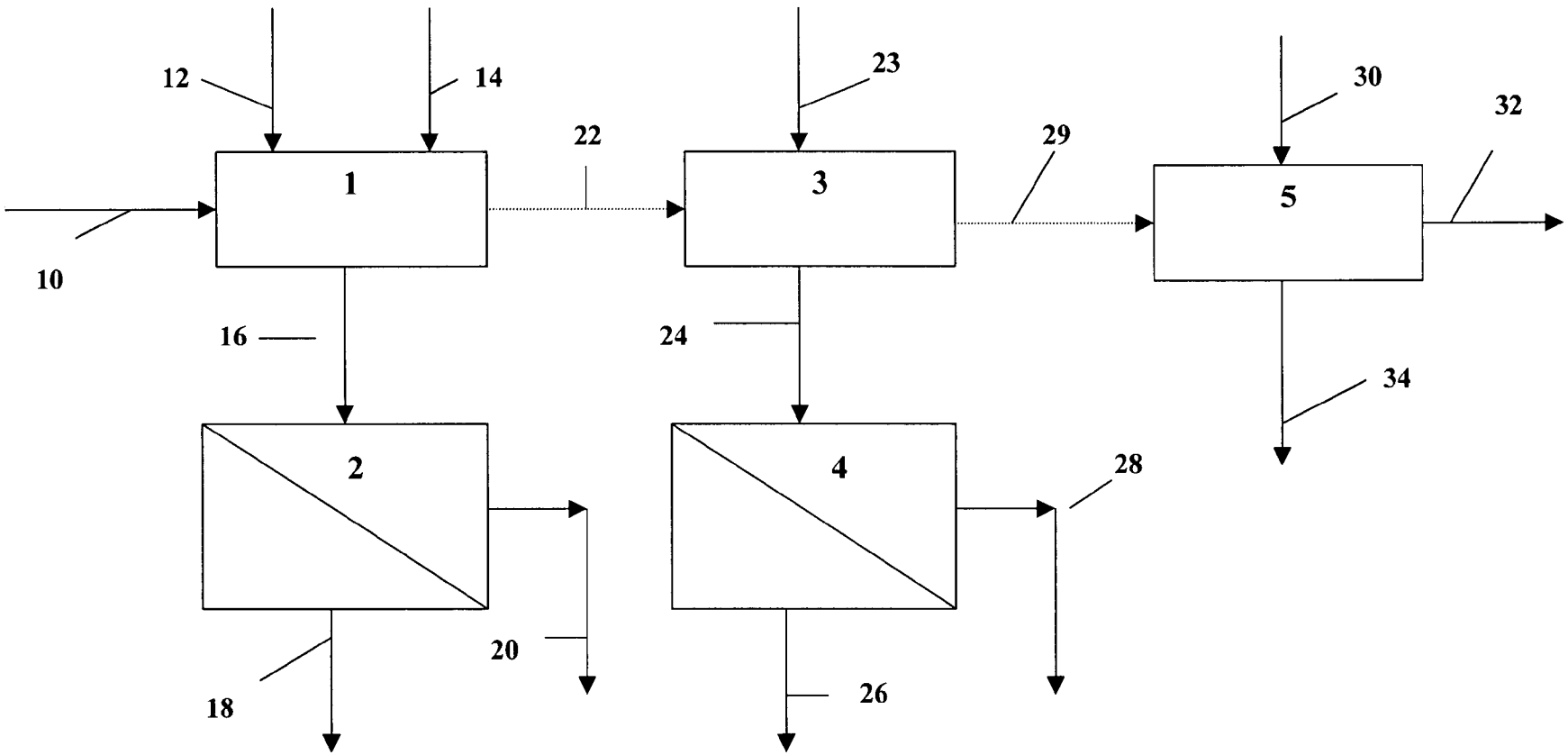
10
12
14
1
16
2
18
20
22
23
3
24
4
26
28
29
30
5
32
34

PROCESS FOR REMOVING THE FUZE FROM EXPLOSIVE PROJECTILES USING FLUID JET TECHNOLOGY

FIELD OF THE INVENTION

The present invention relates to a process for defuzing explosive projectiles using fluid jet technology. It is preferred that two or more projectiles be defuzed simultaneously in the same defuzing apparatus. The explosive material can also be removed from the casing by fluid jet technology, after the projectile has been defuzed.

BACKGROUND OF THE INVENTION

Surplus munitions present a problem to the US military. Current budget constraints force the US military to prioritize its spending while effectively defending the interests of the United States. Defense budgets are further tightened because aging and surplus munitions must be guarded and stored. The US military regularly destroys a significant amount of its surplus munitions each year in order to meet its fiscal challenge. It also destroys a significant amount of munitions each year due to deterioration or obsolescence.

In the past, munitions stocks have been disposed of by open burn/open detonation (OBOD) methods—the most inexpensive and technologically simple disposal methods available. Although such methods can effectively destroy munitions, they fail to meet the challenge of minimizing waste by-products in a cost effective manner. Furthermore, such methods of disposal are undesirable from an environmental point of view because they contribute to the pollution of the environment. For example, OBOD technology produces relatively high levels of $NO_x$, acidic gases, particulates, and metal waste. Incomplete combustion products can also leach into the soil and contaminate ground water from the burning pits used for open burn methods. The surrounding soil and ground water must often be remediated after OBOD to meet environmental guidelines. Conventional incineration methods can also be used to destroy munitions, but they require a relatively large amount of fuel. They also produce a significant amount of gaseous effluent that must be treated to remove undesirable components before it can be released into the atmosphere. Thus, OBOD and incineration methods for disposing of munitions become impractical owing to increasingly stringent federal and state environmental protection regulations. Further, today's even stricter environmental regulations require that new munitions and weapon system designs incorporate demilitarization processing issues. Increasingly stringent EPA regulations will not allow the use of OBOD or excessive incineration techniques, so new technologies must be developed to meet the new guidelines.

U.S. Pat. Nos. 5,363,603 and 5,737,709 teach the use of an fluid jet technology for cutting explosive shells and removing the explosive material. Various fluids can be used, including water and solvents in which the explosive material is soluble. The fluid jet can also carry an abrasive component to enhance the rate of cutting. These patents do not suggest the simultaneous removal of the fuze and explosive material of two or more explosive projectiles.

Conventional explosive removal processes require that the projectile, or shell, first be defuzed. Current fuze removal techniques are either too costly or unsafe. For example, personnel often must remove the fuze by hand at great personal risk. A remote-controlled robot is sometimes used to defuze projectiles, but are costly given the percentage of projectiles that explode during defusing.

While some of the above methods have met with varying degrees of success, there still remains a need in the art for improved methods and apparatus for demilitarizing explosive shells in an environmental, efficient, and safe manner.

SUMMARY OF THE INVENTION

In accordance with the present invention there is provided a process for removing the fuze from an explosive projectile comprised of an explosive-filled metal casing having a tapered nose end and a substantially flat base end, and having a fuze at least one of said ends, which method comprises:

directing a jet of fluid along a predefined path around the perimeter of said fuze an effective number of times to cut through said casing, which fluid is at a sufficient pressure to cause said fluid to cut at least partially through said casing each time said fluid jet makes a complete trip along said path, thereby cutting out said fuze from said casing.

In a preferred embodiment, the jet of fluid makes multiple complete trips along said path before freeing said fuze from said casing.

In another preferred embodiment of the present invention the jet of fluid makes only a single complete trip along said path before cutting through and freeing said fuze from said casing.

In yet another preferred embodiment of the present invention the fluid contains an abrasive material to enhance cutting.

Also in accordance with the present invention, there is provided a process for removing the fuze and the explosive from an explosive projectile comprised of an explosive-filled metal casing having a tapered nose end and a substantially flat base end, and having a fuze at least one of said ends, which method comprises:

a) directing a jet of fluid along a predefined path around the perimeter of said fuze an effective number of time to cut through said casing, which fluid being at a sufficient pressure to cause said fluid to cut at least partially through said casing each time said jet of high pressure fluid makes a complete trip along said path, thereby cutting out said fuze from said casing; and b) directing a jet of fluid onto said explosive material at a pressure sufficient to cause said explosive material to be removed from said casing.

In another preferred embodiment of the present invention the fluid directed onto the explosive material is a solvent with respect to at least one of the components of the explosive material.

Also in accordance with the present invention there is provided a process for removing the fuze and explosive material from two or more projectiles simultaneously in an apparatus comprised of a fuze cut-out stage, an explosive washout stage, and a rinse stage, which projectiles contain an explosive material; which process comprises:

a) providing two or more of said projectiles;

b) simultaneously removing the fuze from each of said two or more projectiles by use of jets of high pressure fluid directed along a predetermined path around the perimeter of said fuze an effective number of times and at an effective pressure to cause cutting of said projectile casing, thereby exposing the explosive material in said casing and resulting in said fluid used for cutting said casing and said fuzes separated from said casings;

c) separating said fuzes from said fluid;

d) simultaneously removing the explosive material from said two or more defuzed projectiles by use of high pressure liquid, thereby resulting in demilitarized shells and a liquid containing the explosive material;

e) passing the liquid containing the explosive material to a separation stage wherein said explosive is separated from said liquid;

f) simultaneously rinsing said two or more demilitarized shells with a suitable liquid.

BRIEF DESCRIPTION OF THE FIGURE

The sole FIGURE shows one preferred embodiment of the present invention for practicing the invention.

DETAILED DESCRIPTION OF THE INVENTION

Any explosive projectile, particularly military shells, can be demilitarized by practice of the present invention. It is preferred to demilitarize those projectiles that are relatively easily handled by a human operator of the fluid jet apparatus of the present invention. For example, the most preferred size of the projectile is from about 3 inches to about 10 inches in diameter, although smaller and larger diameter projectiles can also be accommodated. Such projectiles are typically comprised of a cylindrical metal outer casing having a tapered forward, or nose, section and a flat rear, or base section. Although the base section typically contains the fuze, the nose section, or both the base section and the nose section, may contain a fuze. The interior of the projectile contains the explosive material.

The present invention is not limited to any particular explosive material. Non-limiting examples of explosive materials that can be removed from the explosive projectiles using the present invention include: ammonium perchlorate (AP); 2,4,6 trinitro-1,3-benzenediamine (DATB), ammonium picrate (Explosive D); cyclotetramethylene tetranitramine (HMX); nitrocellulose (NC); nitroguanidine (NQ); 2,2-bis[(nirtoxy)methyl]-1,3-propanediol dinitrate (PETN); hexahydro-1,3,5-trinitro-1,3,5-triazine (RDX); 2,4,5-trinitrophenol (TNP); hexahydro-1,3,5-benzenetriamine (TATB); N-methyl N-2.4.6-tetranitrobenzeneamine (Tetryl); 2-methyl-1,3,5-trinitrobenzene (TNT); Amatol (Ammonium Nitrate/TNT); Baratol ($Ba(NO_3)_2$/TNT; black powder ($KNO_3$/S/C); Comp A (RDX/wax); Comp B (RDX/TNT); Comp C (RDX/plasticizer); Cyclotol (RDX/TNT); plastic bonded explosives (PBX); LOVA propellant; NACO propellant; any combination of the above materials; rocket propellant; and Octol (HMX/TNT). Most preferred are Explosive D, HMX, RDX, TNT, and mixtures thereof.

Referring now to FIG. 1 the explosive projectiles to be defuzed and demilitarized by practice of the present invention are moved to fuze cut-out stage 1 via line 10. Fluid is introduced into cut-out stage 1 via line 12 and abrasive, if used, via line 14. It is preferred that fuze cut-out stage 1 be capable of simultaneously processing two or more projectiles, preferably three or more projectiles, and more preferably four projectiles. The projectiles are positioned so that the surface of each shell containing a fuze opposes a fluid jet nozzle that is positioned to direct a jet of high pressure fluid in a predetermined path around the perimeter of the fuze. It is preferred that the path be a closed path. For example, the path will typically be a closed circle since the fuze will typically have a circular shape. The projectiles can be made to rotate so that the fluid jet from the nozzles are directed in the predetermined path around the outside perimeter of the fuze. Alternatively, the nozzles can be made to rotate to track the same predetermined path around the perimeter of the fuze. It is within the scope of the present invention that both the projectiles and the fluid jet rotate. The fluid jet will be of sufficient pressure to cause cutting of the shell casing. The cutting of the projectile casings to remove the fuzes may be done by either of two procedures. For example, the cutting can be conduced gradually along the cutting path around the perimeter of the fuze by making multiple passes along the cutting path until the fluid jet cuts through the casing and the fuze is isolated and washed free of the casing by the cutting fluid. During this procedure, the depth of the cut during each pass along the cutting path increases gradually so that piercing, or cutting entirely through, the casing is a gradual process. This procedure is preferred when it is only desired to remove the fuze and not to immediately remove the explosive material from the projectile. Alternatively, the pressure of the fluid jet can be substantially increased so that the base of the projectile is pierced and the high pressure fluid jet is directed along the cutting path only once while cutting entirely though the base of the casing during its travel around the perimeter of the fuze. This procedure has the advantage of removing the fuze of the shells while simultaneously removing at least a portion of the explosive material. The operating pressure of the fluid jets will be from about 20,000 to about 150,000 psig, preferably from about 40,000 to about 150,000 psig.

It is preferred that the fluid contain an abrasive material to enhance the cutting. Non-limiting examples of abrasive materials that are suitable for use in the present invention include glass, silica, alumina, silicon carbide, garnet, as well as elemental metal and metal alloy slags and grits. It is preferred that the abrasive either have sharp edges or that it be capable of fracturing into pieces having sharp cutting edges, such as for example, octahedron or dodecahedron shaped particles. The size of the abrasive particles may be any suitable effective size. By effective size, is meant a size that will be effective for removing the material of which the shell casing is manufactured (typically a metal alloy, such a steel) and which is effective for forming a substantially homogeneous mixture with the fluid carrier. Useful particle sizes for the abrasive material range from about 3 mm to 55 microns, preferably from about 15 mm to 105 microns, and most preferably from about 125 microns to about 250 microns. Generally, the most preferred abrasives have been found to be garnets and aluminum-based materials having a particle size from about 125 microns mesh to about 250 microns.

The concentration of the abrasive within the fluid may generally range in slurry fluid jet systems from about 1 to about 50 wt. %, preferably from about 10 to 40 wt. %, and most preferably from about 25 to 35 wt. %. For entrained fluid jet systems the amount of abrasive will generally comprise about 5 wt. % to 30 wt. %, preferably from about 10 wt. % to about 25 wt. % of total fluid plus abrasive, depending on the diameter of the orifice of the nozzle. Increasing the concentration generally has a tendency to increase the cutting efficacy of the fluid jet composition.

The fluid of the fluid jet is preferably any suitable normally liquid. By "normally liquid" we mean that it will be in the liquid state at substantially atmospheric temperatures and pressures. For example, it can be water, or a solvent in which at least a portion of the explosive material being removed is at least partially soluble. In one preferred embodiment of the present invention the fluid used to cut out the fuze(s) is water and the fluid to washout, or cut out, the explosive material is a solvent with respect to at least one component of the explosive material. It is preferred that the fluid be nontoxic so as to maintain the environmental usefulness of the cutting/demilitarization process. Non-limiting examples of organic solvents that can be used in the practice of the present invention include: alkyl alcohols, alkyl ketones, alkyl nitriles, nitroalkanes, and halo-alkanes. More particularly, the alkyl group of the organic solvent may be branched, cyclic, or straight chain of from about 3 to 20 carbons. Examples of such alkyl groups include octyl, dodecyl, propyl, pentyl, hexyl, cyclohexyl, and the like. Methanol and ethanol are the preferred alcohols. The alcohols may also contain such alkyl groups. Non-limiting examples of ketones include acetone, cyclohexanone, propanone, and the like. Non-limiting examples of nitro compounds that can used as the carrier for the fluid jet in the practice of the present invention are acetonitrile, propylnitrile, octylnitrile, and the like. Non-limiting examples of halogenated alkanes include methylene chloride, chloroform, tetrahaloethylene and perhaloethane, and the like. Preferably, aqueous and aqueous/organic mixtures are used as the fluid which are more preferably nontoxic and cost effective, given the compatibility with the explosive material to be removed. Such more preferred fluids include, propylene and ethylene glycol, fuel oil compositions such as gasoline and diesel oil, water, short chain alkyl alcohols, mineral oil, glycerine, and mixtures thereof.

While the fluid may comprise any number of aqueous, organic, or aqueous/organic mixtures, the fluid is capable of producing a relatively low viscosity fluid jet that can pass through an orifice of the nozzles used in the practice of the present invention. Typically the orifices will be from about 0.002 inch to about 0.054 inch in diameter. Such orifices are readily commercially available and are typically fabricated from sapphires and diamonds.

It is also within the scope of this invention that the fluid contain a suitable surfactant. Surfactants suitable for use herein comprise a relatively broad class of compounds that are generally classified as anionic, cationic, non-ionic, and amphoteric. These surfactants may be produced by any known methods from precursors such as fluorocarbons, fatty acids, amines, sulfates, esters, alcohols, and the like. Non-limiting examples of surfactants that may be used in the practice of the present invention include: sulfonic acids, sulfonates, alkylates, ether sulfates, ethoxylates, aliphatics, polyethers, aklylamine oxides, alkylbutanes, diethanolamines, lauryl sulfates, ethoxylated esters, fatty acid alkoxylates, fatty diethanolamides, fluorinated surfactants, glycerol monostearates, lauric diethanolamines, oleic acid, dimethylamines, phosphate esters, polyethylene glycol monooleates, quaternary alkyl amines, sulfylcuccinates, tridecyloxypoly (ethyleneoxy) ethanols, and the like. The concentration of the surfactants may range from a few wppm to a major portion of the cutting fluid. For slurry fluid systems the surface active agent may comprise about 0.001 wt. % to about 10 wt. %, preferably from about 0.01 wt. % to 5 wt. %, and most preferably from about 0.05 wt. % to 1 wt. %, based on the total weight of the fluid.

During the fuze-cutting stage, abrasive material (if used) and fluid are collected and passed, via line 12, to abrasive separation unit 2 where the abrasive material is separated from the fluid by conventional solid-liquid separation techniques, including gravity settling, filtration, and centrifugation. The abrasive material and the fluid are separately collected via lines 12 and 14 respectively, and each can be recycled to fuze cut-out stage 1.

After the projectiles are defuzed, they are subjected to an explosive washout stage 3 which will most likely be in the same apparatus as cut-out stage 1. Line 22 is shown in the case the defused shells need to be physically moved to a different station. In washout stage 3 the shells are subjected to a fluid jet that is used to cut into the interior of the projectile and remove the explosive material. Fluid enters washout stage 3 via line 23. The exposed explosive material is subjected to a high pressure jet of washout fluid that will preferably be delivered by a translationally mobile, rotating nozzle mounted at the end of a hollow lance. It will be understood that the present invention can also be practiced by rotating the projectiles instead of, or in addition to, rotating the fluid jet nozzles.

Although the fluid jet used for this explosive wash-out step can contain abrasive material, it is preferred that the fluid be used without abrasive material and that it be a solvent with respect to at least one component of the explosive material. The resulting waste stream from this explosive wash-out step 3 will contain both explosive material and wash-out fluid. This mixture is sent via line 24 to separation unit 4 where the explosive material is recovered from the wash-out fluid, also by conventional solid-liquid separation techniques. The washout fluid can be collected via line 28 for recycle and the explosive material collected via line 26 for reuse or further processing. The wash-out fluid can be water or any of the above mentioned solvents.

It is preferred that the resulting demilitarized projectile casings be subjected to a rinse stage 5 to achieve a so-called "5×cleanliness"s. 5×cleanliness is usually required by Army Material Command Regulation 385-5 for explosives and Army Command Regulation 385-61 for chemical weapons. If this rinse stage is not in the same apparatus as the washout stage the shells are moved via line 29 from the washout stage to the rinse stage. A rinse fluid, preferably water, is introduced to rinse stage 5 via line 30 where it is used to rinse out any remaining explosive material or organic liner material contaminants. The cleaned casings are collected via line 32 and can be sold as scrap metal. The rinse fluid is collected via line 34, and if needed can go through an additional separation stage to remove any such contaminants before it can be recycled.

The recovered explosive material can be passed to an additional stage wherein the explosive material is converted to useful and commercially valuable chemicals. For example, if the explosive component is tritonal (TNT plus aluminum powder) or Composition B (RDX plus aluminum powder) the fluid of the fluid jet can preferably be a solvent in which only the TNT or RDX is soluble and not the aluminum powder. The aluminum powder is recovered by conventional solid-liquid separation techniques and the TNT or RDX is covered by evaporating the solvent and recrystallizing the TNT or RDX. Such process are taught in co-pending U.S. patent application Ser. Nos. 09/569,661 and 09/569,662, entitled respectively Reclaiming TNT and Aluminum From Tritonal and Tritonal-Containing Munitions, and Reclaiming RDX and Aluminum from Composition B and Composition B-Containing Munitions, both of which are incorporated herein by reference. If the explosive is ammonium picrate it can be converted to picric acid in a two phase system as disclosed in U.S. Pat. No. 5,998,676, which is also incorporated herein by reference.

What is claimed is:

1. A process for defuzing and removing the explosive material from two or more projectiles simultaneously in an apparatus comprised of a fuze cut-out stage, an explosive washout stage, a separation stage, and a rinse stage, wherein each projectile is comprised of an explosive-filled metal casing having a tapered nose end and a substantially flat base end, and having a fuze at least one of said ends, which process comprises:

a) providing two or more of said projectiles;

b) simultaneously removing the fuze from each of said two or more explosive projectiles by directing a jet of fluid containing from about 1 wt. % to about 50 wt. %, of an abrasive material, which wt. % is based on the total weight of the fluid plus abrasive material, along a predefined path around the perimeter of a fuze on each of said projectiles an effective number of times to cut through said casing, which jet of fluid plus abrasive material is at a sufficient pressure to cause said jet of fluid plus abrasive material to cut at least partially through said casing each time said jet of fluid containing abrasive material travels along the length of said path, thereby cutting out said fuze from said casing of each projectile;

c) passing said fluid from the jet of fluid and the abrasive material to a solid/liquid separation stage wherein the abrasive material is separated from the fluid;

d) recycling at least a portion of the fluid to step b) above;

e) simultaneously removing the explosive material from said two or more defuzed projectiles by use of high pressure fluid, thereby resulting in two or more demilitarized projectiles and a fluid containing said explosive material;

f) passing the fluid of the high pressure fluid containing said explosive material to a separation stage wherein said explosive is separated from said fluid of the high pressure fluid;

g) recycling at least a portion of said fluid of said height pressure fluid to step b) above; and h) removing substantially all remaining explosive material from said two or more demilitarized projectiles simultaneously by rinsing said two or more demilitarized projectiles with a suitable liquid.

2. The process of claim 1 wherein the explosive material is selected from the group consisting of: ammonium perchlorate; 2,4,6 trinitro-1,3-benzenediamine, ammonium picrate; cyclotramethylene tetranitramine; nitrocellulose; nitroguanidine; 2,2-bis[(nirtoxy) methyl]-1,3-propanediol dinitrate; hexahydro-1,3,5-trinitro-1,3,5-triazine; 2,4,5-trinitrophenol; bexahydro-1,3,5-benzenetriamine; N-methyl N-2.4.6-tetranitrobenzeneamine; 2-methyl-1,3,5-trinitrobenzene; ammonium nitrate plus TNT; Baratol ($Ba(NO_3)_2$/TNT; black powder ($KNO_3$/S/C); hexahydro-1,3,5-trinitro-1,3,5-triazine plus wax; hexahydro-1,3,5-trinitro-1,3,5-triazine plus TNT; hexahydro-1,3,5-trinitro-1,3,5-triazine plus plasticizer; plastic bonded explosives; cyclotetramethylene tetranitramine plus TNT, and mixtures thereof.

3. The process of claim 2 wherein the explosive material is selected from the group consisting of TNT, TNT plus aluminum powder, ammonium picrate, cyclotetramethylene tetranitramine, hexahydro-1,3,5-trinitro-1,3,5-triazine plus aluminum powder, and mixtures thereof.

4. The process of claim 1 wherein the abrasive component is selected from the group consisting of glass, silica, alumina, silicon carbide, garnet, elemental metal, and metal alloys.

5. The process of claim 1 wherein said fluid is an aqueous based fluid.

6. The process of claim 1 wherein said fluid is a solvent in which said explosive material is at least partially soluble.

7. The process of claim 1 wherein the pressure of the jet of fluid is from about 20,000 psig to about 150,000 psig.

8. The process of claim 1 wherein said jet of fluid contains a surfactant component selected from the group consisting of anionic, cationic, non-ionic, and amphoteric surfactants.

9. The process of claim 1 wherein the separated abrasive is recycled.

10. The process of claim 1 wherein the solid-liquid separation of step c) is performed by gravity settling, filtration, or centrifugation.

* * * * *